US008707746B1

(12) United States Patent
Liu

(10) Patent No.: US 8,707,746 B1
(45) Date of Patent: Apr. 29, 2014

(54) LOCK WITH REPLACEABLE BOTTOM PINS

(71) Applicant: Federal Lock Co., Ltd., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 13/751,277

(22) Filed: Jan. 28, 2013

(51) Int. Cl.
*E05B 27/00* (2006.01)

(52) U.S. Cl.
USPC ..... 70/493; 70/383; 70/385

(58) Field of Classification Search
USPC ..... 70/492, 493, 382–385, 367, 369
See application file for complete search history.

(56) References Cited

U.S. PATENT DOCUMENTS

| | | | | | |
|---|---|---|---|---|---|
| 2,326,358 | A * | 8/1943 | Hull | 70/385 |
| 2,427,814 | A * | 9/1947 | Schachinger | 70/383 |
| 3,462,983 | A * | 8/1969 | Evanish | 70/383 |
| 4,732,023 | A * | 3/1988 | Shen | 70/383 |
| 4,747,281 | A * | 5/1988 | Monahan | 70/383 |
| 4,836,002 | A * | 6/1989 | Monahan | 70/382 |
| 5,000,019 | A * | 3/1991 | Foster | 70/338 |
| 5,752,400 | A * | 5/1998 | Kim | 70/368 |
| 5,799,519 | A * | 9/1998 | Hsiao | 70/358 |
| 5,921,122 | A * | 7/1999 | Lin | 70/368 |
| 6,698,264 | B1 * | 3/2004 | Liao | 70/493 |
| 6,935,146 | B1 * | 8/2005 | Lin | 70/338 |
| 7,121,127 | B1 * | 10/2006 | Fan | 70/373 |
| 7,181,937 | B2 * | 2/2007 | Keller | 70/338 |
| 7,290,418 | B2 * | 11/2007 | Herdman | 70/383 |
| 7,533,550 | B2 * | 5/2009 | Herdman | 70/340 |
| 7,628,048 | B2 * | 12/2009 | Huang et al. | 70/338 |
| 7,802,455 | B2 * | 9/2010 | Herdman | 70/493 |
| 7,905,124 | B2 * | 3/2011 | Komemi | 70/358 |
| 7,905,125 | B2 * | 3/2011 | Herdman | 70/383 |
| 7,958,759 | B2 * | 6/2011 | Herdman | 70/371 |
| 7,980,106 | B2 * | 7/2011 | Huang et al. | 70/383 |
| 8,056,378 | B2 * | 11/2011 | Huang et al. | 70/338 |
| 8,074,480 | B2 * | 12/2011 | Huang et al. | 70/383 |
| 8,109,122 | B2 * | 2/2012 | Herdman | 70/493 |
| 8,151,611 | B2 * | 4/2012 | Herdman | 70/371 |
| 8,161,783 | B2 * | 4/2012 | Huang et al. | 70/492 |
| 8,266,934 | B2 * | 9/2012 | Lin | 70/337 |
| 2004/0226327 | A1 * | 11/2004 | Chou | 70/358 |
| 2005/0172686 | A1 * | 8/2005 | Yu | 70/358 |
| 2005/0183482 | A1 * | 8/2005 | Lin | 70/493 |
| 2006/0010945 | A1 * | 1/2006 | Herdman | 70/493 |
| 2006/0096345 | A1 * | 5/2006 | Chen | 70/493 |
| 2006/0112748 | A1 * | 6/2006 | Benstead | 70/383 |
| 2009/0217720 | A1 * | 9/2009 | Herdman | 70/385 |

* cited by examiner

*Primary Examiner* — Suzanne Barrett
(74) *Attorney, Agent, or Firm* — Rosenberg, Klein & Lee

(57) ABSTRACT

A lock includes a housing having an axial space and multiple radial top pin holes. Multiple through holes are defined through the housing and located corresponding to the space. A core is located in the space and has multiple radial bottom pin holes which communicate with the top pin holes respectively. A key hole is defined in the first end of the core and a connection member is connected to the second end of the core. The key hole communicates with the bottom pin holes. The housing has a connection portion located corresponding to the connection member. The through holes are located alternatively to the bottom pin holes. When the bottom pin holes are rotated to the through holes and the core moves axially, the connection member is connected to the connection portion. The through holes communicate with the bottom pin holes.

10 Claims, 22 Drawing Sheets

LOCK WITH REPLACEABLE BOTTOM PINS

FIELD OF THE INVENTION

The present invention relates to a lock, and more particularly, to a lock with replaceable bottom pins so as to obtain more sets of combinations without replacing the whole lock.

BACKGROUND OF THE INVENTION

The conventional way to use a lock is prepare suitable number of keys to families so as to unlock the lock, however, the lock is not safe when one of the keys is lost and most of the users will change a new lock for safety reason. The replacement of the locks sometimes cost a lot of money and is not convenient for the users.

FIGS. 1 to 3 show a conventional lock which generally comprises a housing 10 and a core 20, the housing 10 has multiple top pin holes 101 and the core has multiple bottom pin holes 201 which are in communication with the top pin holes 101. Multiple pin units 30 are installed in the top and bottom pin holes 101, 201. A cover 102 is mounted to the top pin holes 101 and the housing 10 has multiple grooves 103 so as to be cooperated with the cover 102. The core 20 has a key hole 202 in one end thereof and the other end of the core 20 has a latch 203.

In normal condition, the key is inserted into the core 20 via the key hole 202 and the notches of the key accommodate the pin units 30 to align the outer surface of the core 20 with the ends of the top and bottom pin holes 101, 201, such that the latch 203 is operated by rotating the key. When the correct key is lost, the pins can be replaced, as shown in FIG. 2, by first removing the cover 102 from the grooves 103 and the pin units 30 are removed from the top and bottom pin holes 101, 201. The suitable pin units 30 are then installed to the top and bottom pin holes 101, 201 according the arrangement of the notches of a new key. The cover 102 is again engaged with the grooves 103 to obtain a new lock.

Nevertheless, when replacing the pins, the pin units 30 are removed from the core 20 only when the top and bottom pin holes 101, 201 are in alignment with each other. Once the diameters of the top and bottom pin holes 101, 201 are different, or the top and bottom pin holes 101, 201 are not in alignment to each other, the pin units 30 are stocked in the lock and the replacement cannot be successfully made. The users are difficult to check whether or not the top and bottom pin holes 101, 201 are in alignment to each other from the top pin holes 101. The new pin units 30 are also not easily to be properly installed into the bottom pin holes 201 so that it is difficult for the users to replace the pins. Besides, the cover 102 is difficult to be removed from the grooves 103, even if only one set of the pin unit 30 is to be replaced, the cover 102 is stilled required to be removed and other pin units 30 may drop out from the lock to further increase the time required to replace the pin units 30.

The present invention intends to provide a lock with replaceable bottom pins, and the replacement is easy.

SUMMARY OF THE INVENTION

The present invention relates to a lock and comprises a housing having a space defined axially therein and multiple top pin holes are defined radially through the housing. The housing has multiple through holes which are located corresponding to the space. A core is located in the space and has multiple bottom pin holes defied radially, the bottom pin holes communicate with the top pin holes respectively. A key hole is defined in the first end of the core and a connection member is connected to the second end of the core. The key hole communicates with the bottom pin holes. The housing has a connection portion located corresponding to the connection member. The through holes are located alternatively to the bottom pin holes. When the bottom pin holes are rotated to the through holes and the core moves axially, the connection member is connected to the connection portion, and the through holes communicate with the bottom pin holes.

Preferably, the connection member has a protrusion located corresponding to the connection portion.

Preferably, the bottom pin units are received in the bottom pin holes via the through holes.

Preferably, the housing has a groove and the core has a positioning unit on the outside thereof, the positioning unit is selectively engaged with the groove.

Preferably, the positioning unit comprises a block, a resilient piece and a positioning piece. The block is connected to the outside of the core. A room is defined between the core and the block. The resilient piece and the positioning piece are located in the room. The block has an elongate hole. The resilient piece has a first end contacting the outside of the core and a second end of the resilient piece is connected to the positioning piece. The positioning piece extends through the elongate hole and is selectively engaged with the groove.

Preferably, the housing has a stop connected thereto and the stop has at least one aperture which is located corresponding to the top pin hole. Multiple top pin units are located in the top pin holes. One of the top pin units comprises a top pin and a resilient member. The top pin has a driving member on a top thereof and the driving member extends through the at least one aperture.

Preferably, the at least one aperture has an inclined face which is gradually and outwardly narrowed.

Preferably, a transmission unit is connected to the second end of the core.

Preferably, the housing has at least one side pin hole defined therethrough and the at least one side pin hole is located between the top pin hole and the through hole. The at least one side pin hole receives a side pin unit.

Preferably, the side pin unit comprises a side pin and a spring member. The housing has a filling hole which is located diametrically in opposite to the at least one side pin hole. The side pin unit is inserted into the at least one side pin hole via the filling hole, and the filling hole is covered by a cover.

The primary object of the present invention is to provide a lock which is easily to replace the bottom pin units so as to improve the shortcomings of the convention locks.

When replacing the key, the core is rotated to align the bottom pin holes with the through holes, the housing and the core are released by releasing the positioning unit. The protrusion on the E-shaped clip is engaged with the recess so as to drive the core axially and to change the relationship between the bottom pin holes and the through holes from the alternative arrangement to the alignment arrangement. The bottom pin units are able to be replaced via the through holes. The top pin with the driving member is compressed to push the stop so as to replace the top pin units from the top pin holes.

Furthermore, by the side pin units and the position unit, when the lock is hit or picked from exterior, the side pin units are stocked in the bottom pin holes so that the core cannot be rotated or returned, and the positioning unit stops tool from entering the gap of the housing to provide two protections against unauthorized actions to the lock.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
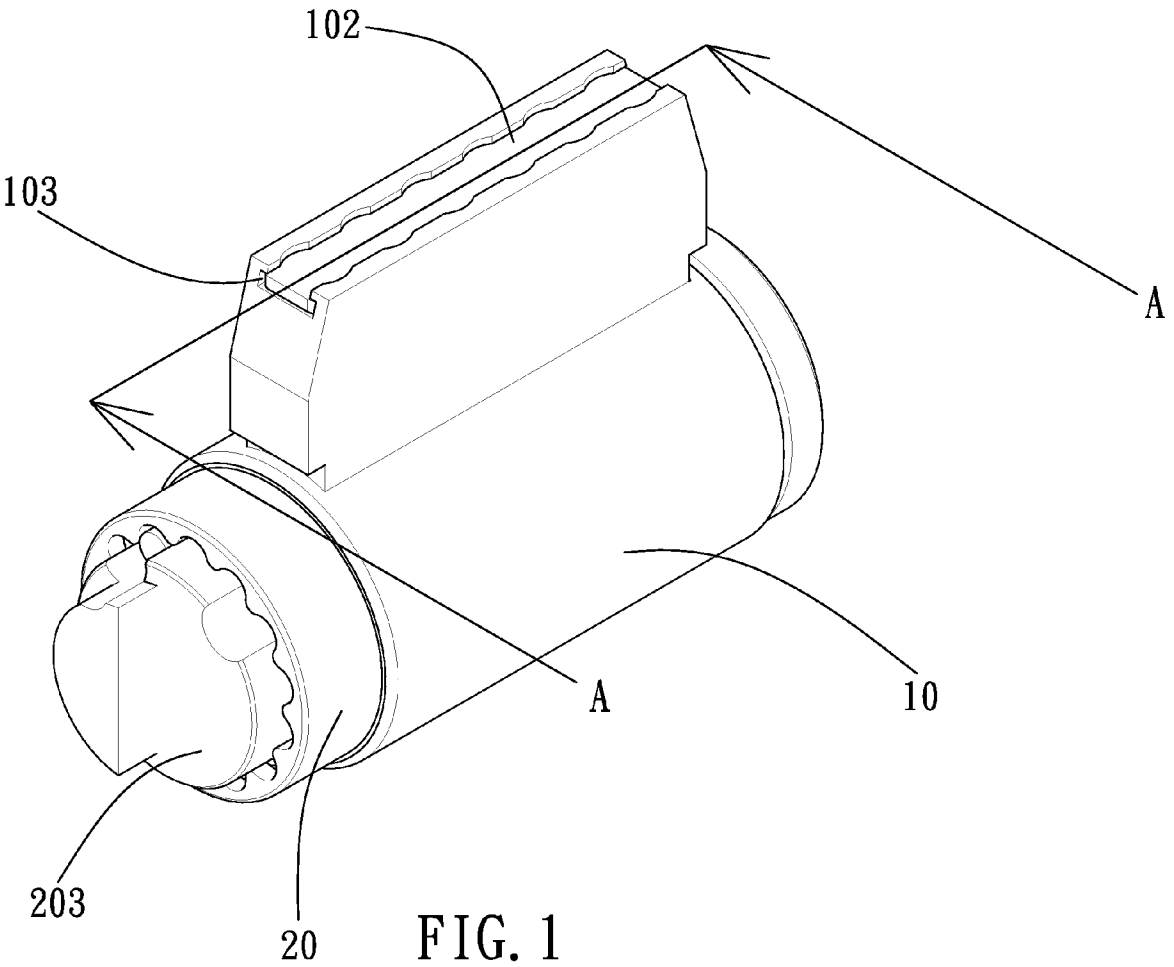
FIG. 1 Prior Art
FIG. 1 is a perspective view to show the conventional bottom-pins replaceable lock.
Figure 2:
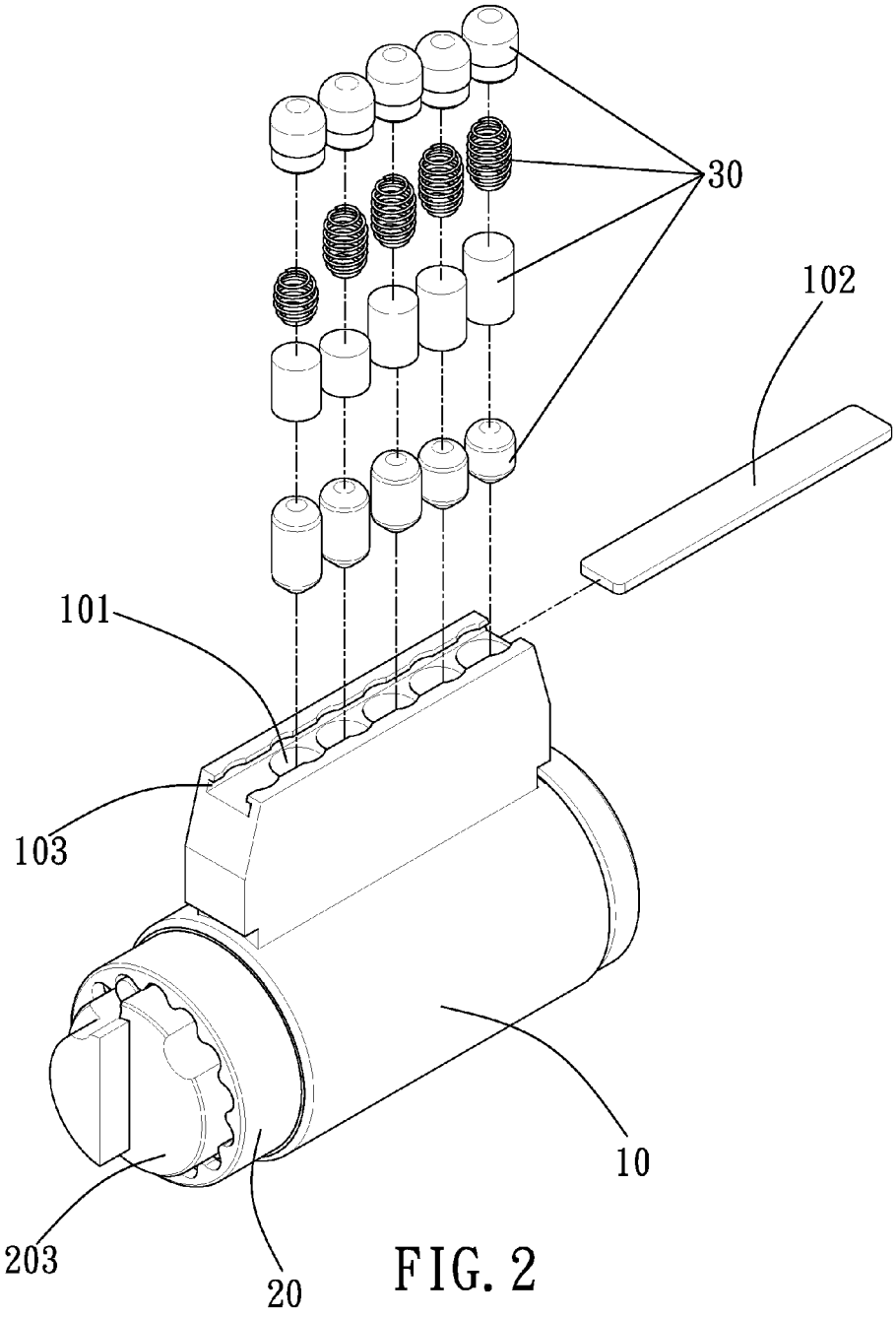
FIG. 2 Prior Art
FIG. 2 is an exploded view to show the conventional bottom-pins replaceable lock.
Figure 3:
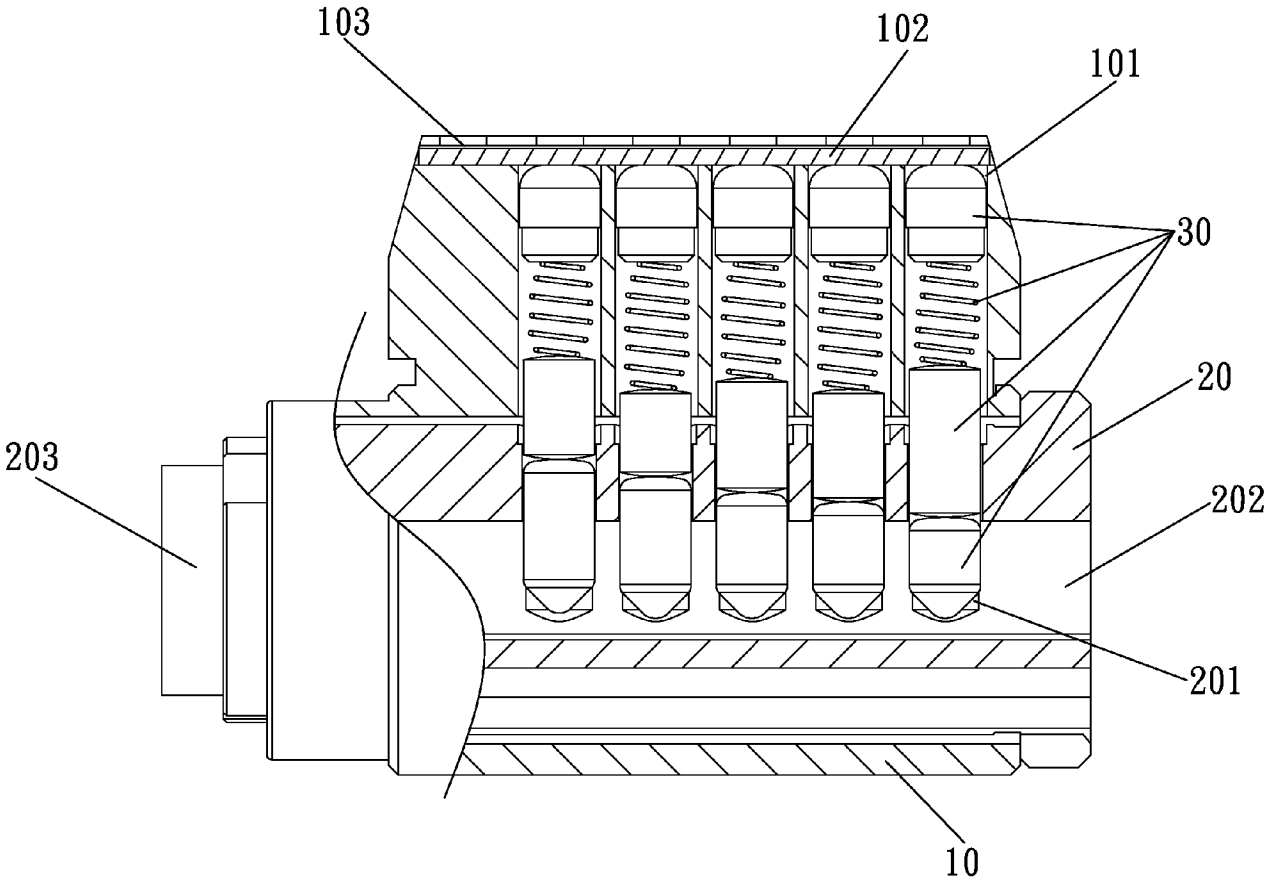
FIG. 3 Prior Art
FIG. 3 is a cross sectional view, taken along line A-A in FIG. 1.
Figure 4:
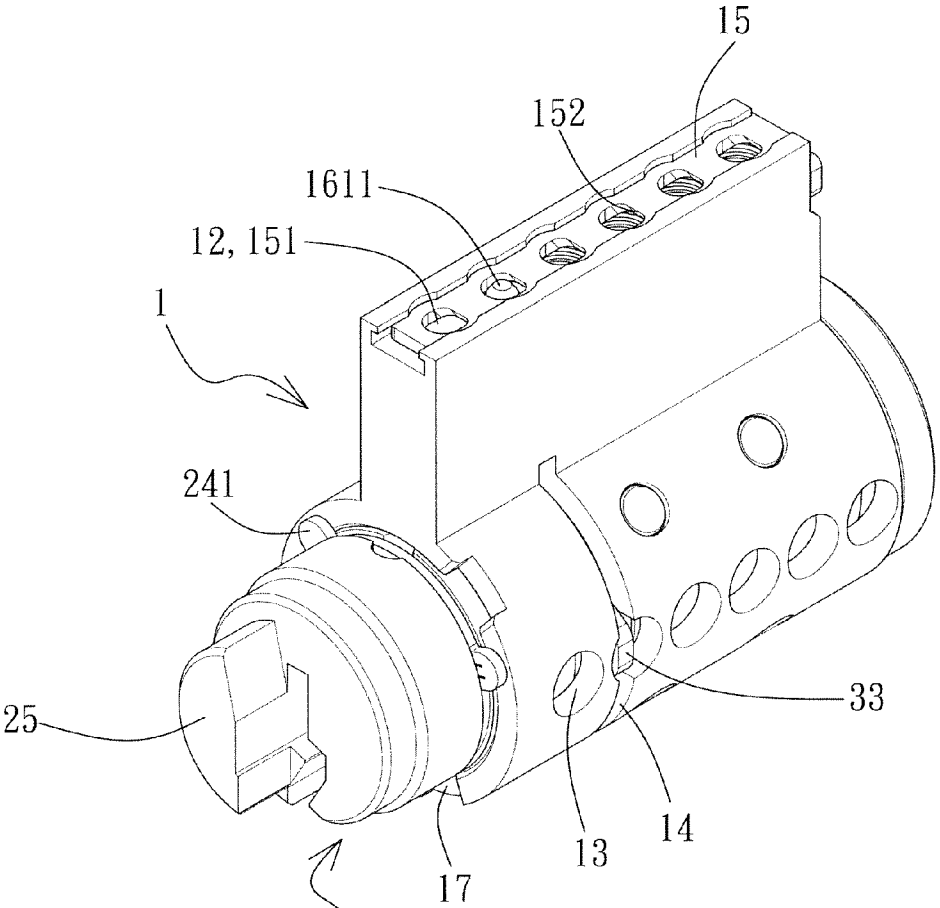
FIG. 4 is a perspective view to show the lock of the present invention.
Figure 5:
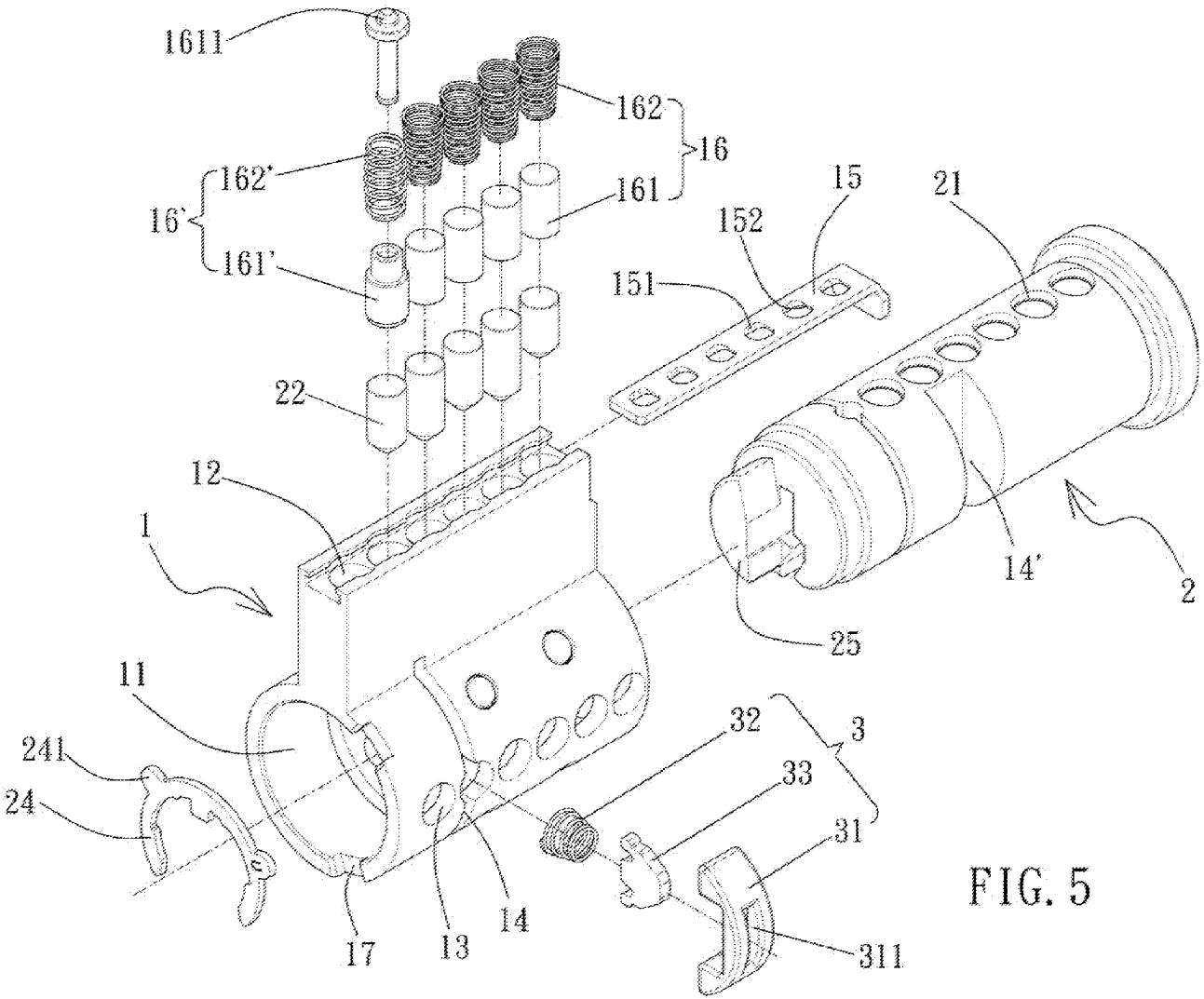
FIG. 5 is an exploded view to show the lock of the present invention.

Referring to FIGS. 4 and 5, the lock of the present invention comprises a housing 1 having a space 11 defined axially therein and multiple top pin holes 12 are defined radially through the housing 1. The housing 1 has multiple through holes 13 which are located corresponding to the space 11. The housing 1 further has a groove 14 and a stop 15 is connected to the housing 1. The stop 15 has apertures 151 which are located corresponding to the top pin holes 12 and each of the apertures 151 has an inclined face 152 is gradually and outwardly narrowed. Multiple top pin units 16 are located in the top pin holes 12 and each top pin unit 16 has a top pin 161 and a resilient member 162. One of the top pin units 16' comprises a top pin 161' and a resilient member 162', the top pin 161' has a driving member 1611 on the top thereof and the driving member 1611 extends through the aperture 151.

Figure 6:
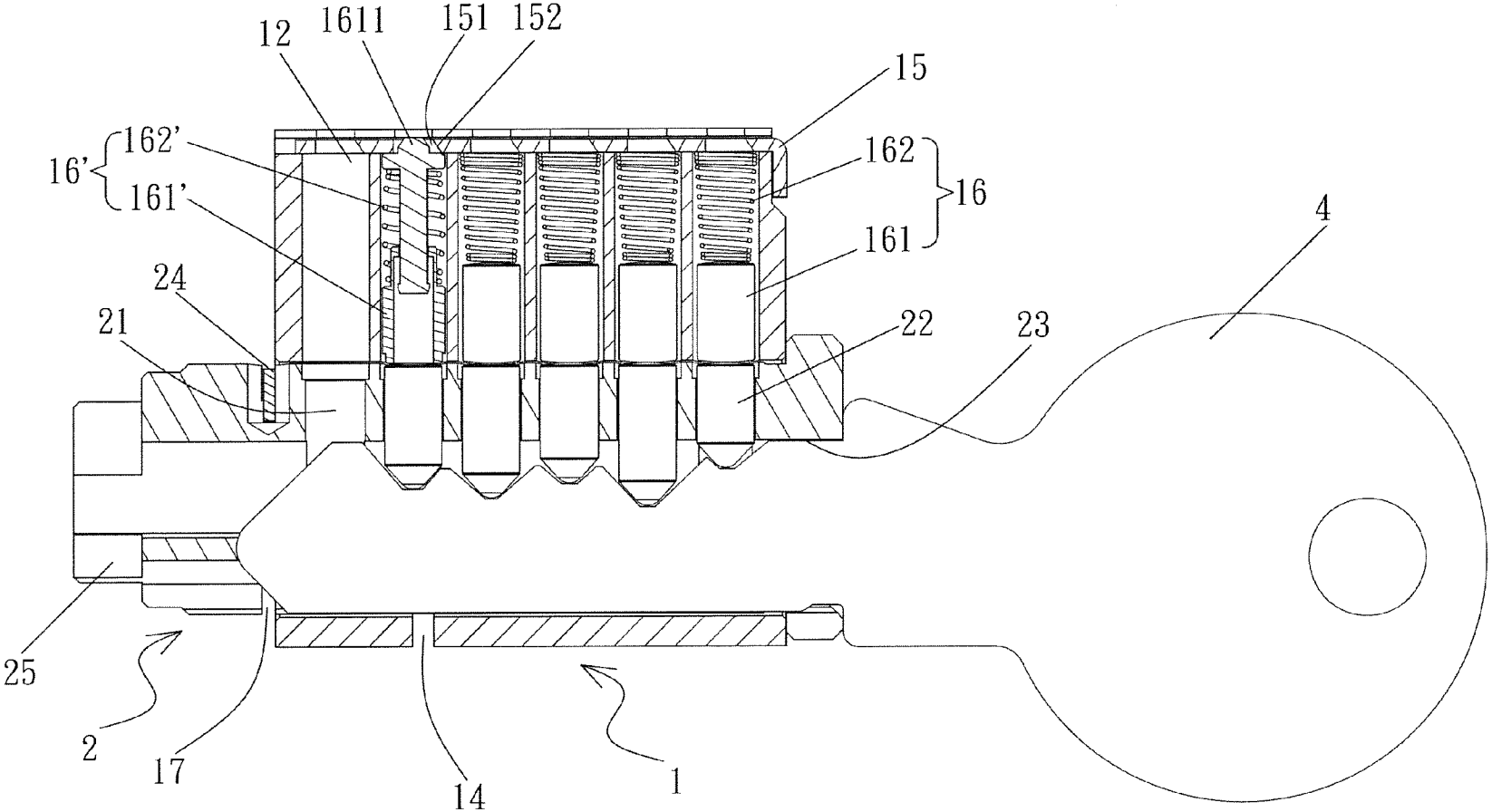
FIG. 6 is a cross sectional view to show that the first key is inserted into the lock of the present invention.

A core 2 is located in the space 11 and has multiple bottom pin holes 21 defined radially, the bottom pin holes 21 communicate with the top pin holes 12 respectively. The bottom pin units 22 are received in the bottom pin holes 21. The diameter of the through holes 13 allows the bottom pin units 22 to be inserted into the bottom pin holes 21. A key hole 23 is defined in the first end of the core 2 and a connection member 24 and a transmission unit 25 are connected to the second end of the core 2 as shown in FIG. 6. The connection member 24 has a protrusion 241 extending therefrom. The key hole 23 communicates with the bottom pin holes 21. The housing 1 has a connection portion 17 located corresponding to the connection member 24. The through holes 13 are located alternatively to the bottom pin holes 21. The diameters of the through holes 13 allow the bottom pin units 22 to be installed into the bottom pin holes 21 via the through holes 13. In this embodiment, the connection member 24 is an E-shaped clip and the connection portion 17 is a recess which is located corresponding the protrusion 241.

A positioning unit 3 comprises a block 31, a resilient piece 32 and a positioning piece 33. The block 31 is connected within a core recess 14' defined to extend from an inner portion of the core 2 to the outside of the core 2 (as shown in FIG. 5), and a room is defined between the core 2 and the block 31. The resilient piece 32 and the positioning piece 33 are located in the room. The block 31 has an elongate hole 311. The resilient piece 32 has its first end contacting the outside of the core 2 and the second end of the resilient piece 32 is connected to the positioning piece 33. The positioning piece 33 extends through the elongate hole 311 and is selectively engaged with the groove 14.

Figure 7:
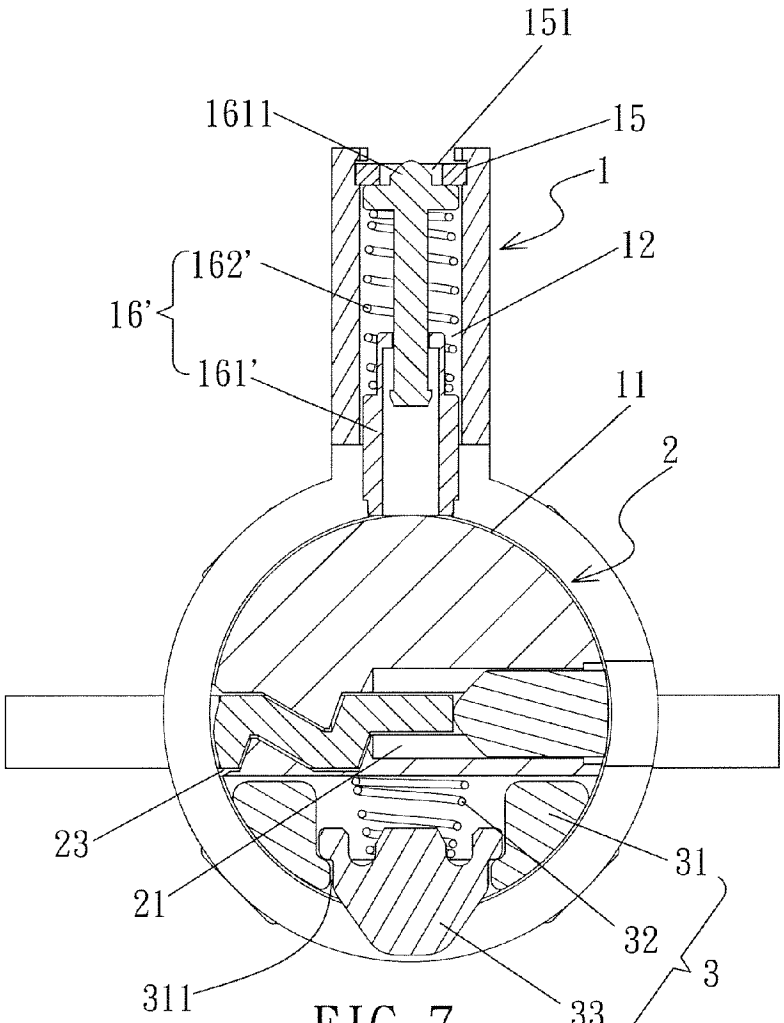
FIG. 7 is a cross sectional view to show that the first key is rotated to rotate the core if the lock of the present invention.
Figure 8:
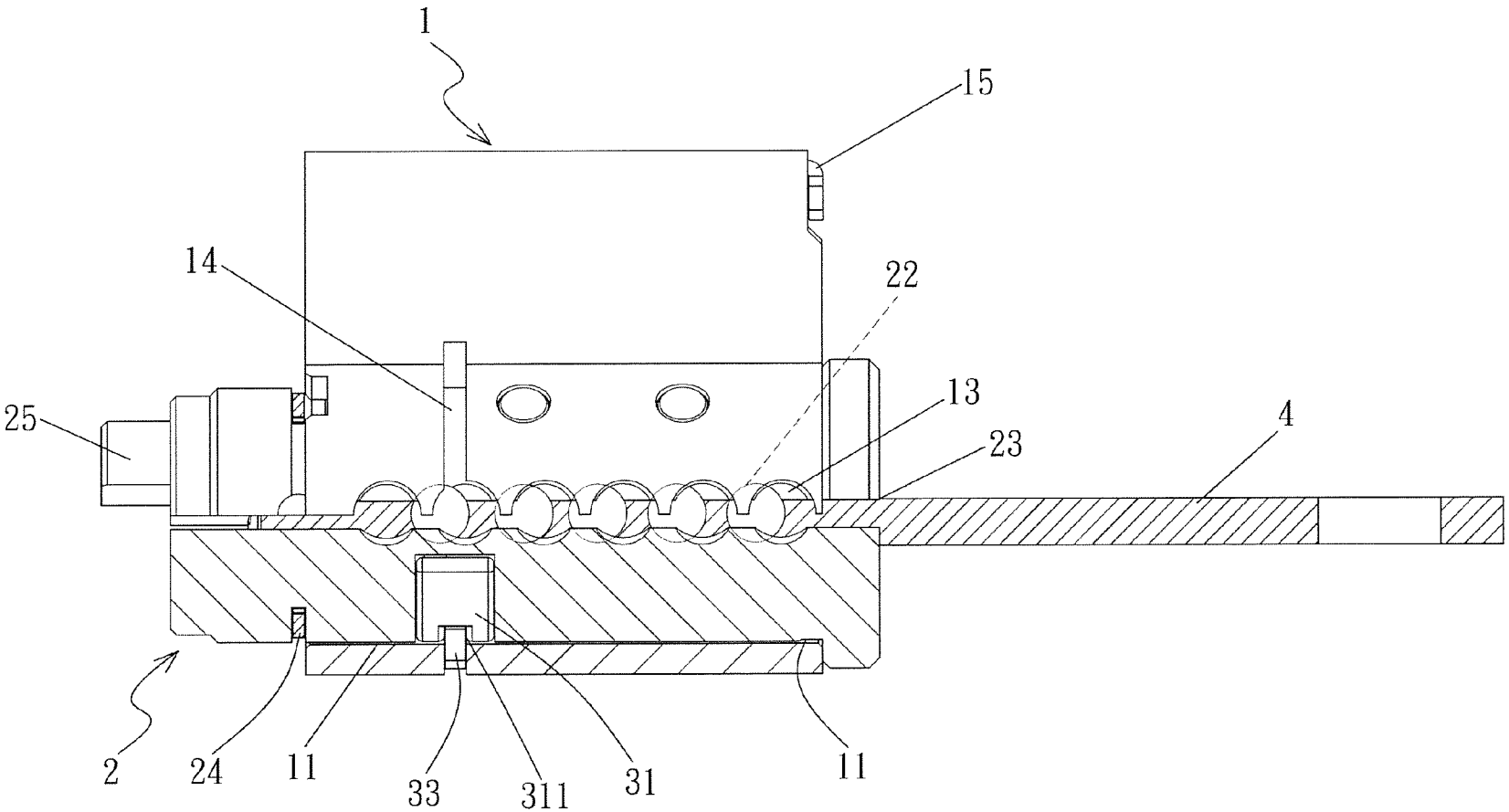
FIG. 8 is a cross sectional view to show that the bottom pin holes and the through holes of the lock of the present invention are located alternatively to each other.

As shown in FIG. 6, the first key 4 is inserted into the key hole 23 and rotated to unlock the lock, the core 2 is driven by the first key 4 and the transmission unit 25 and the bottom pin holes 21 are co-rotated with the core 2 to let the lock be unlocked. When the bottom pin holes 21 are rotated to the through holes 13, as shown in FIGS. 7 and 8, the bottom pin holes 21 are rotated to the through holes 13 are located alternatively to each other so that the bottom pin units 22 are located within the bottom pin holes 21, so that the core 2 is rotatable 360 degrees and the bottom pin units 22 do not drop from the bottom pin holes and the through holes 13.

Figure 9:
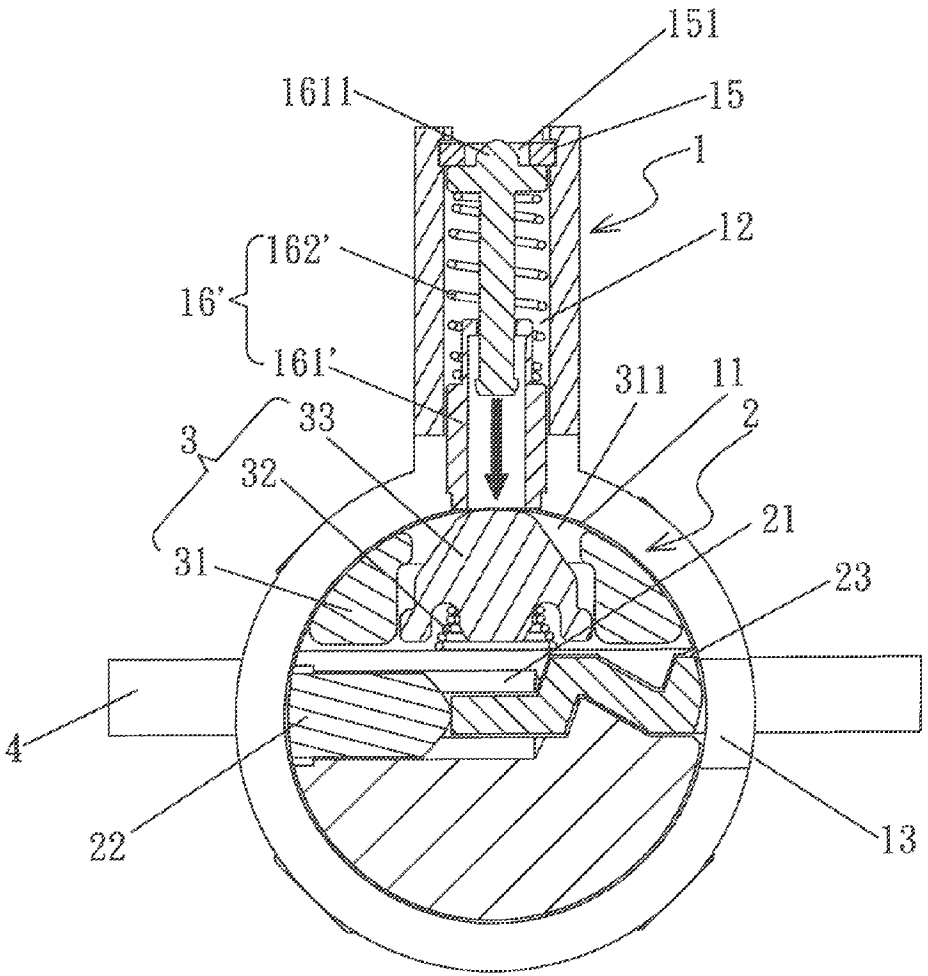
FIG. 9 is a cross sectional view to show that the positioning unit are pushed by the top pin units when the core is rotated.
Figure 10:
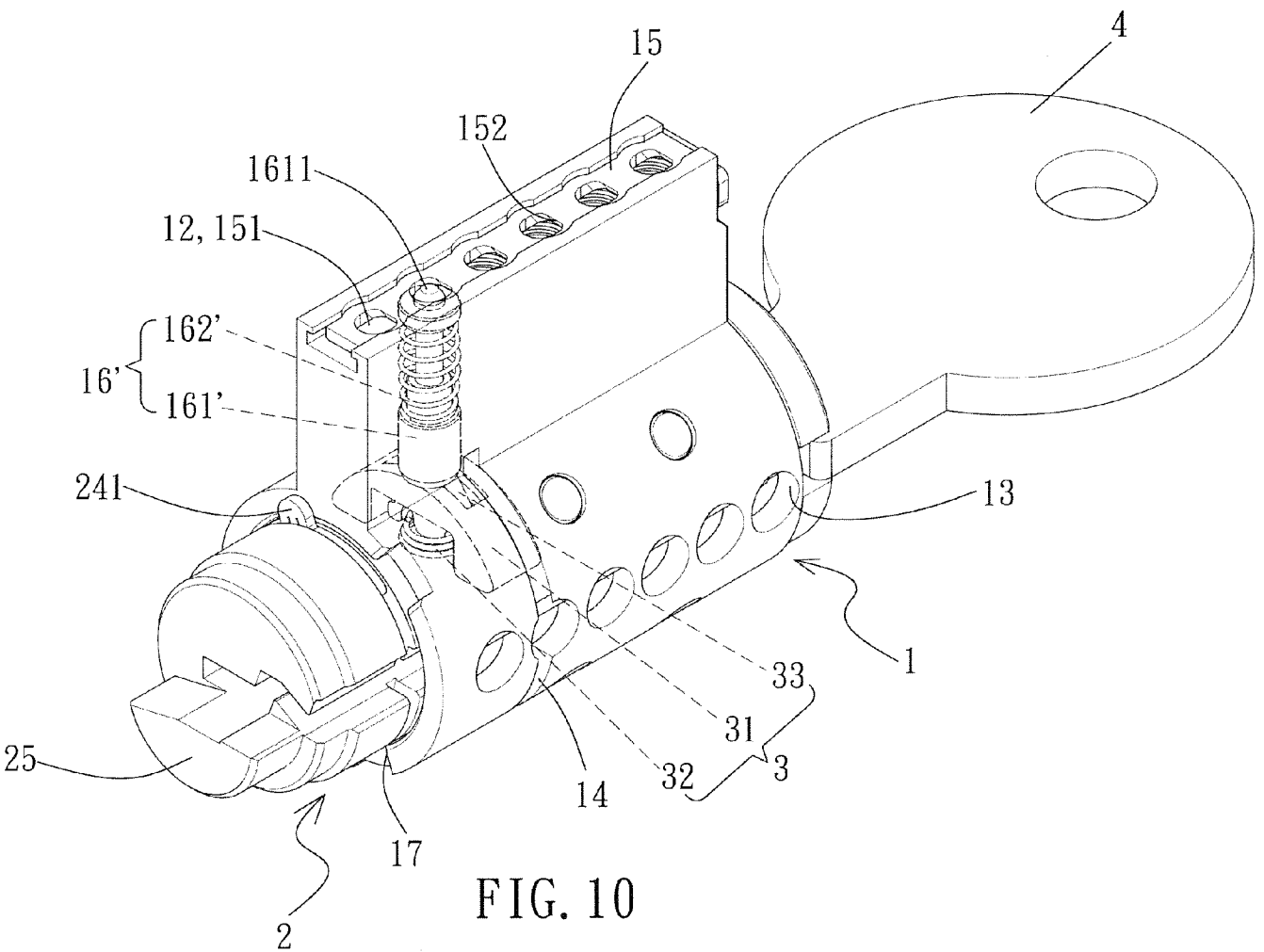
FIG. 10 is a perspective view to show that the positioning unit are pushed by the top pin units, and the connection member and the connection portion are located alternatively to each other.
Figure 11:
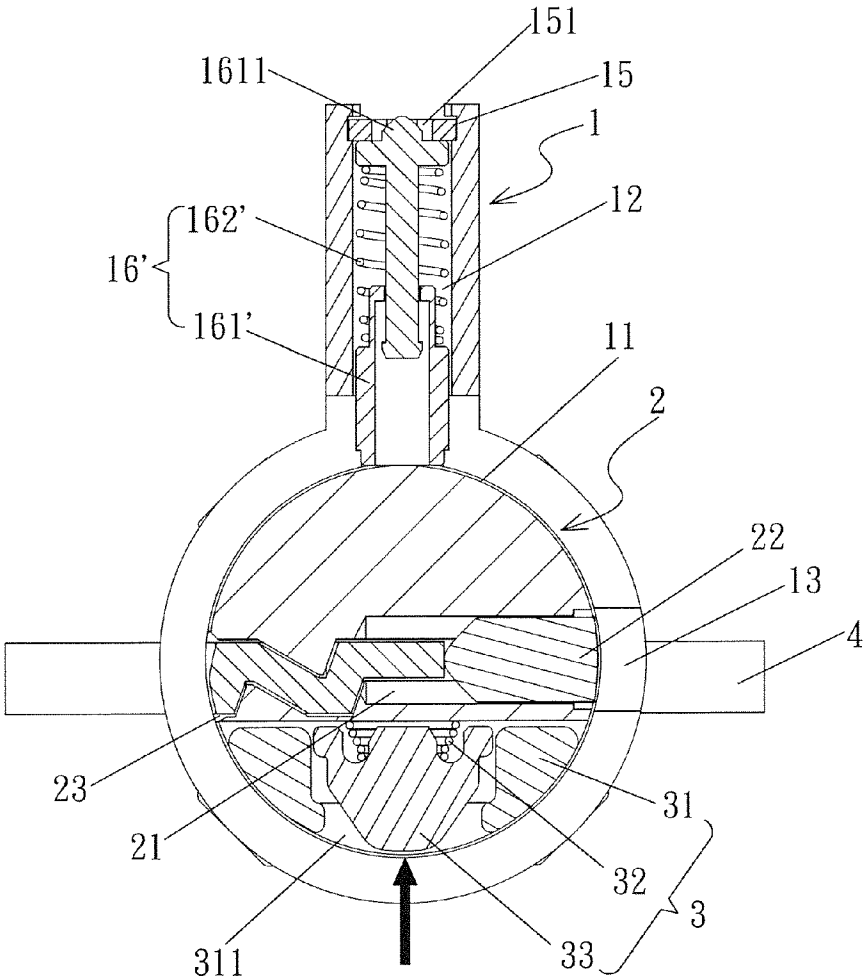
FIG. 11 is a cross sectional view to show that the positioning unit are pushed.
Figure 12:
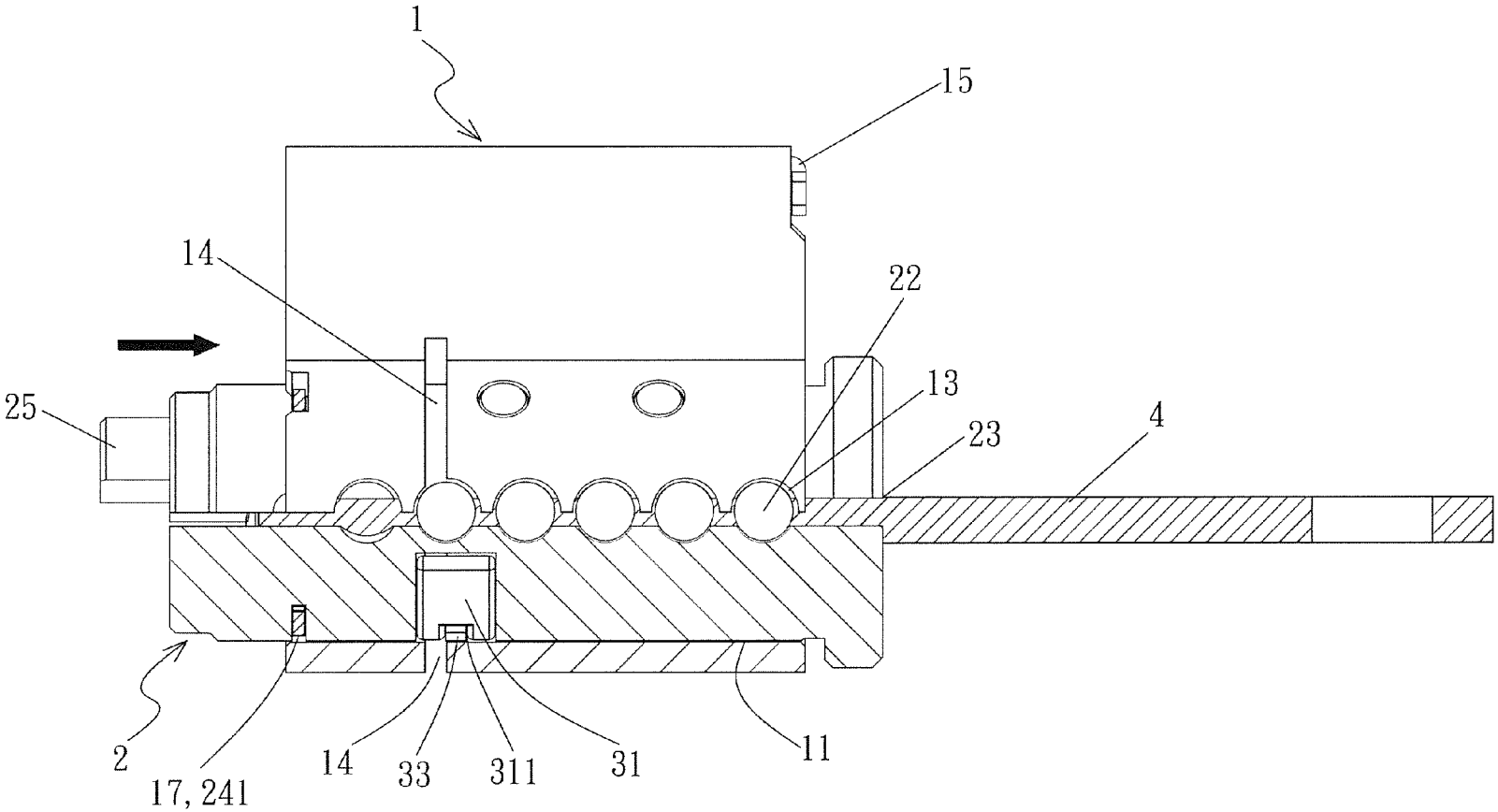
FIG. 12 is a cross sectional view to show that the bottom pin holes are in flush with the through holes of the lock of the present invention.
Figure 13:
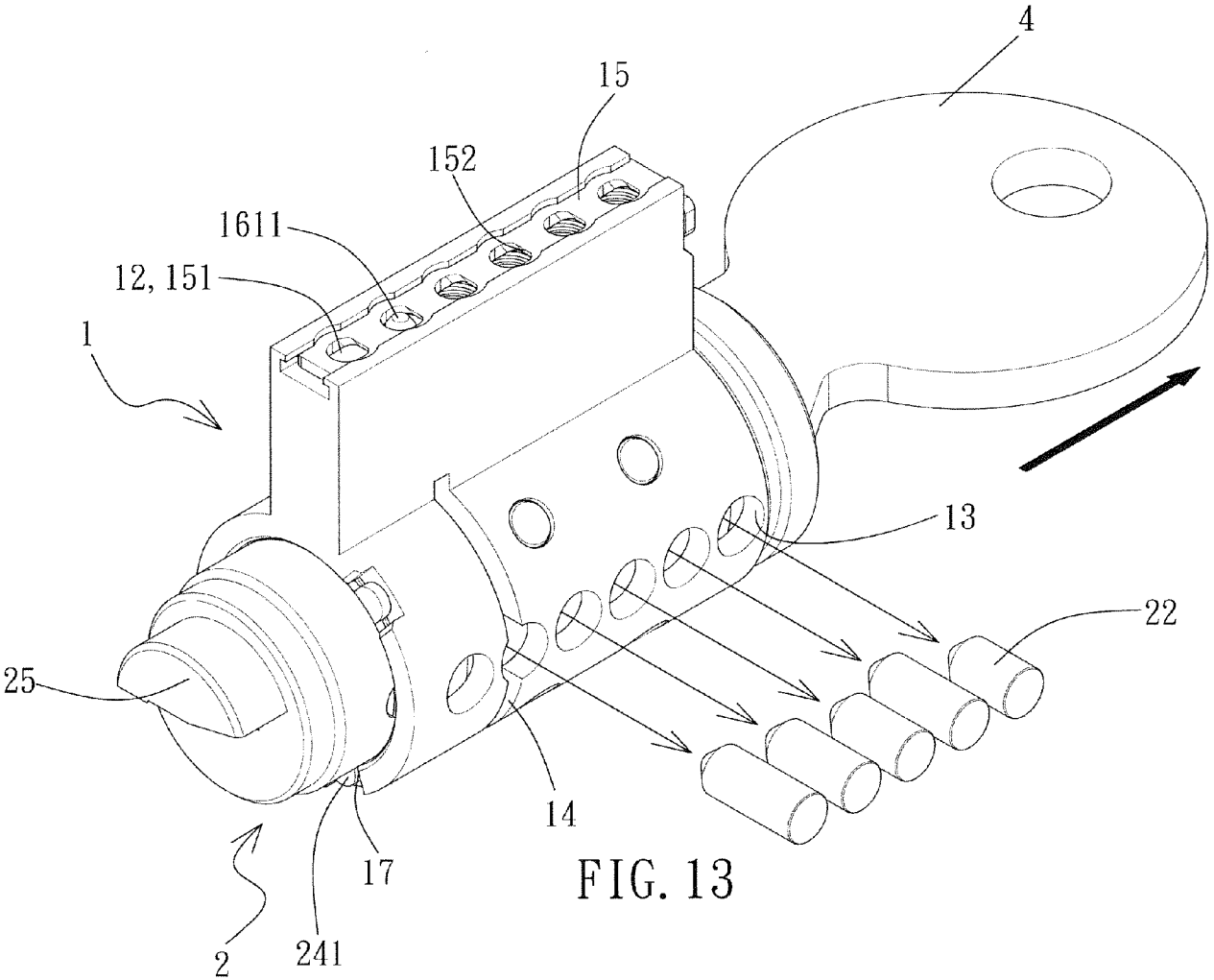
FIG. 13 shows that the first key is removed and the bottom pin units are pulled out.
Figure 14:
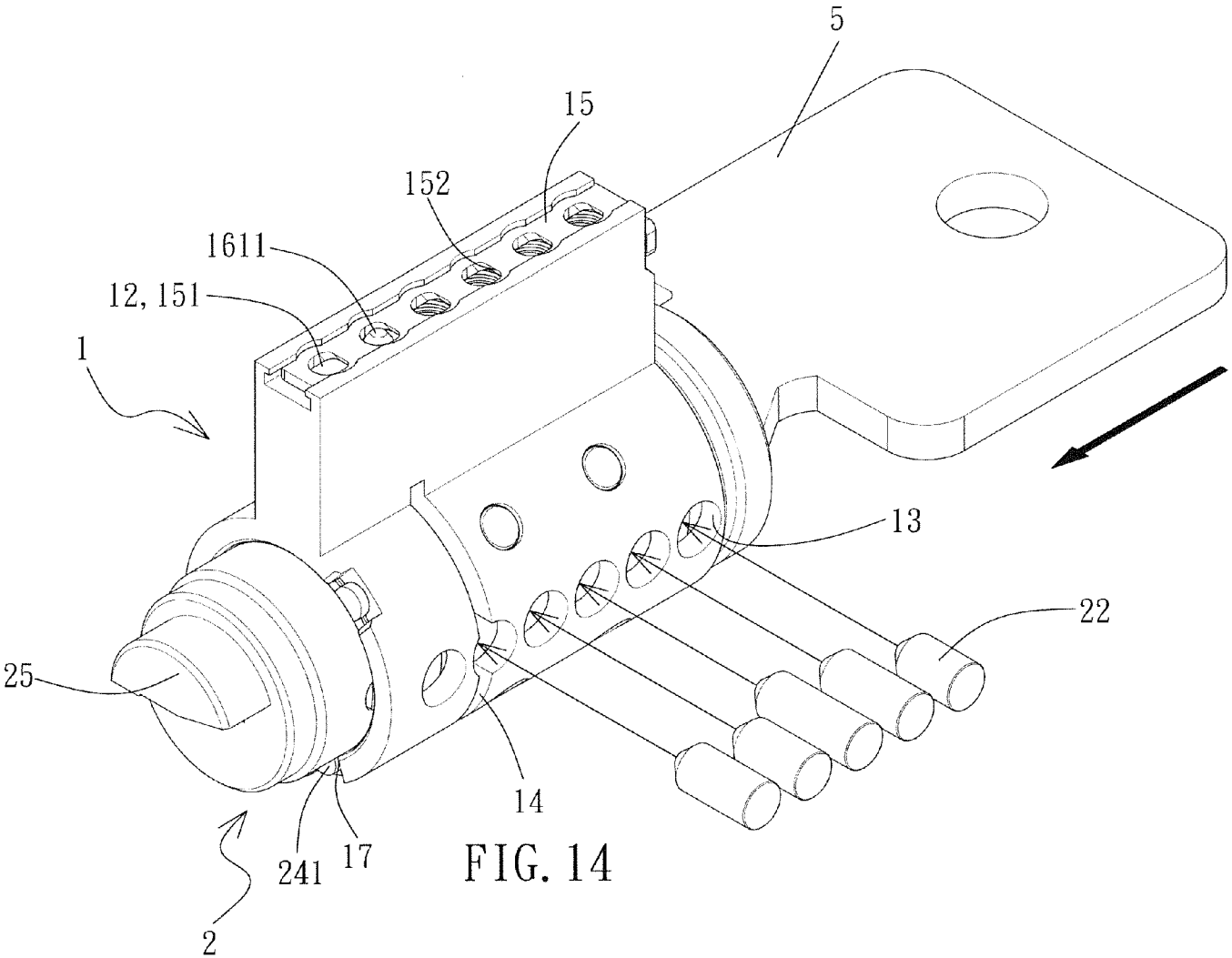
FIG. 14 shows that the second key is inserted into the key hole and the same sets of the new bottom pin units are installed.
Figure 15:
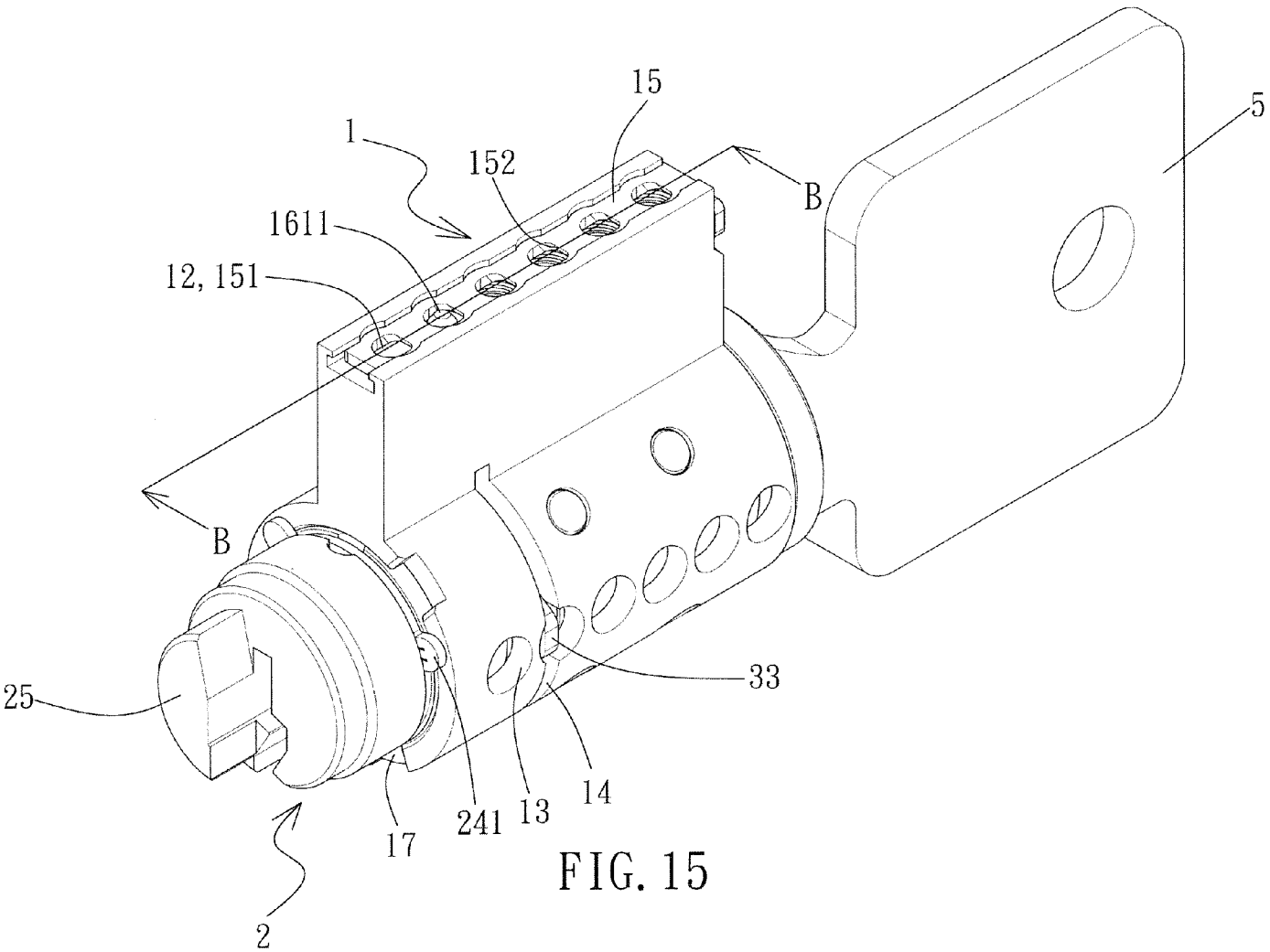
FIG. 15 shows that the second key is inserted into the key hole.
Figure 16:
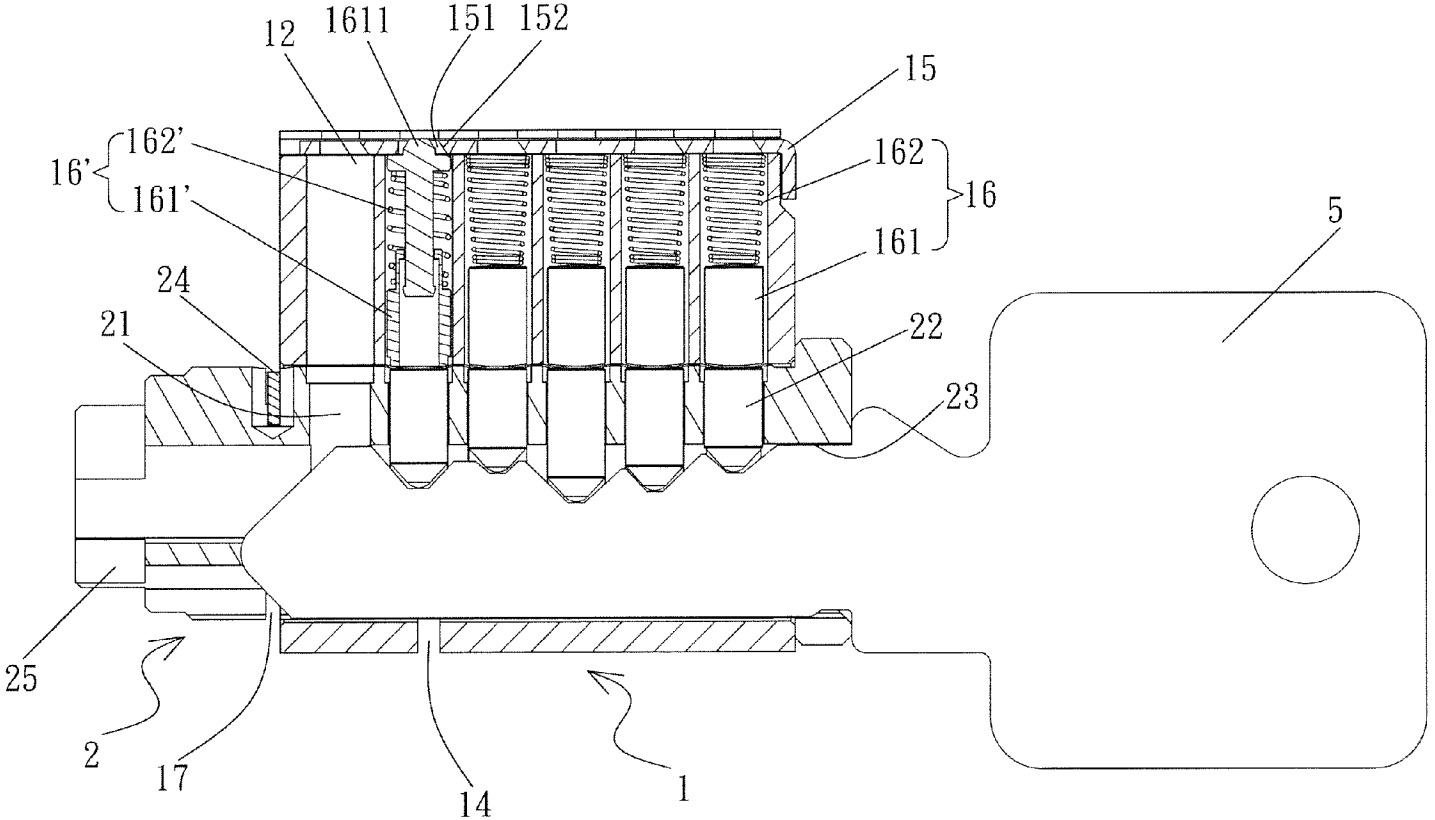
FIG. 16 is a cross sectional view, taken along line B-B in FIG. 15.
Figure 17:
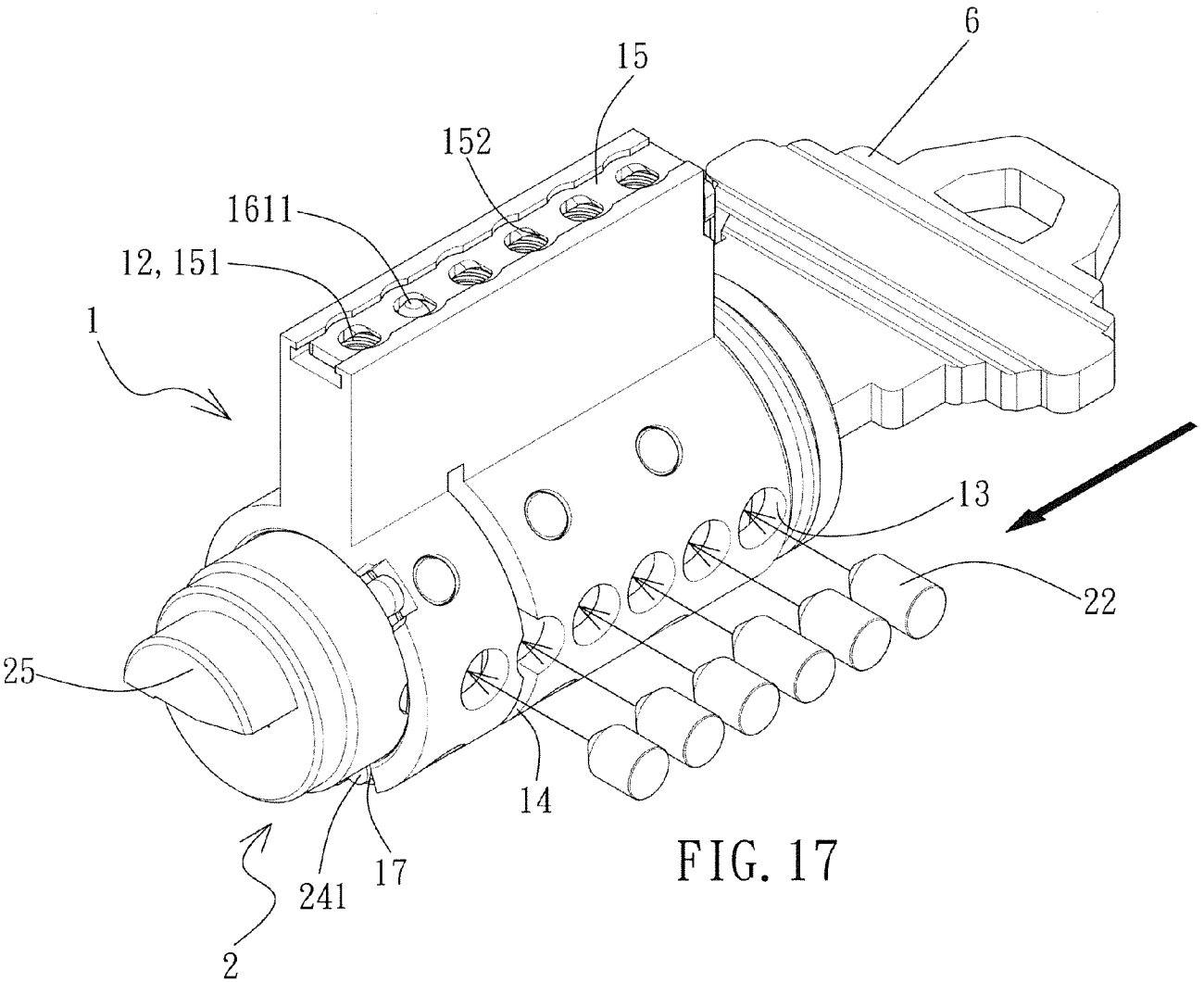
FIG. 17 shows that the third key is inserted into the key hole and different sets of the new bottom pin units are installed.
Figure 18:
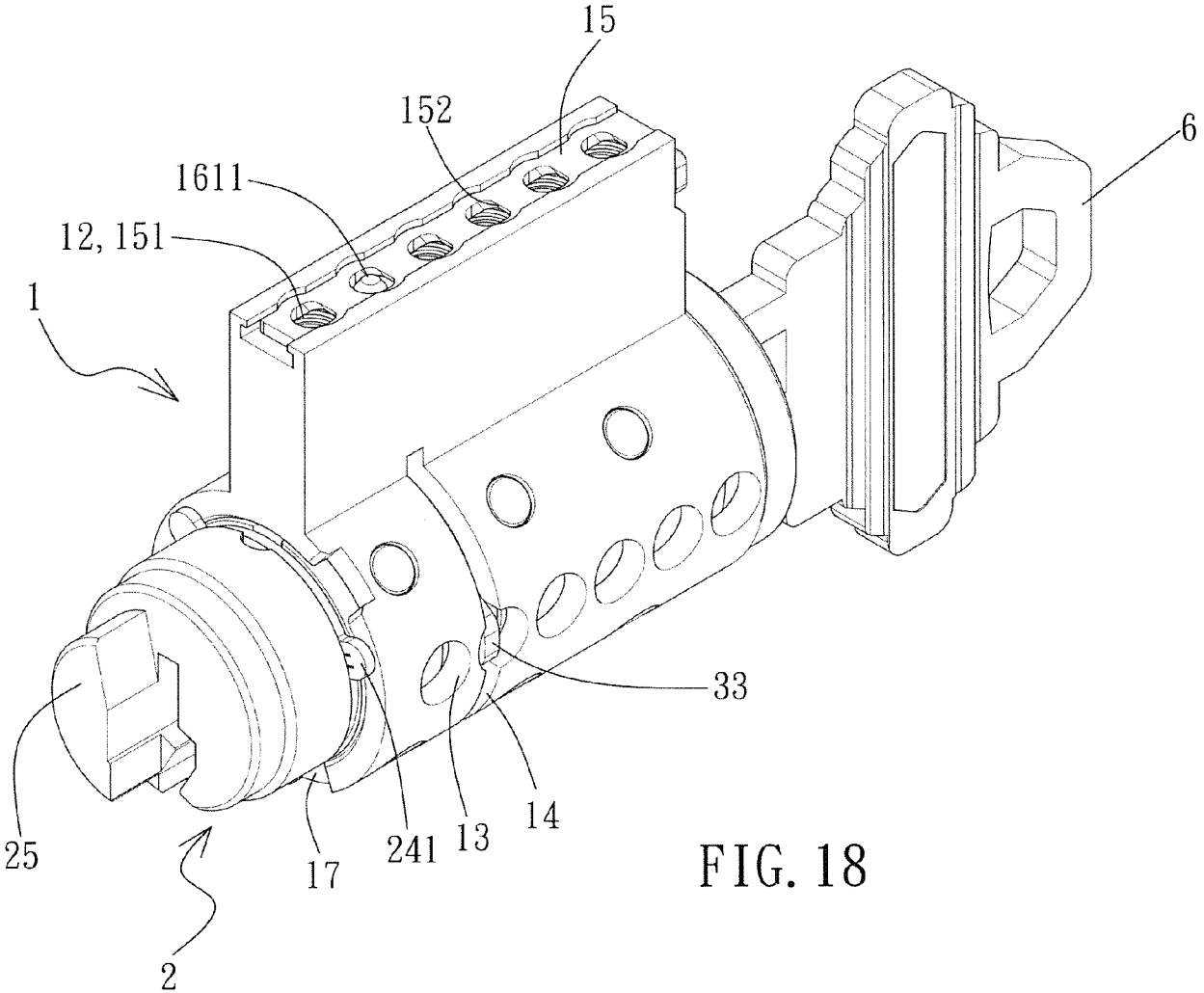
FIG. 18 is a perspective view to show that the third key is inserted into the key hole.
Figure 19:
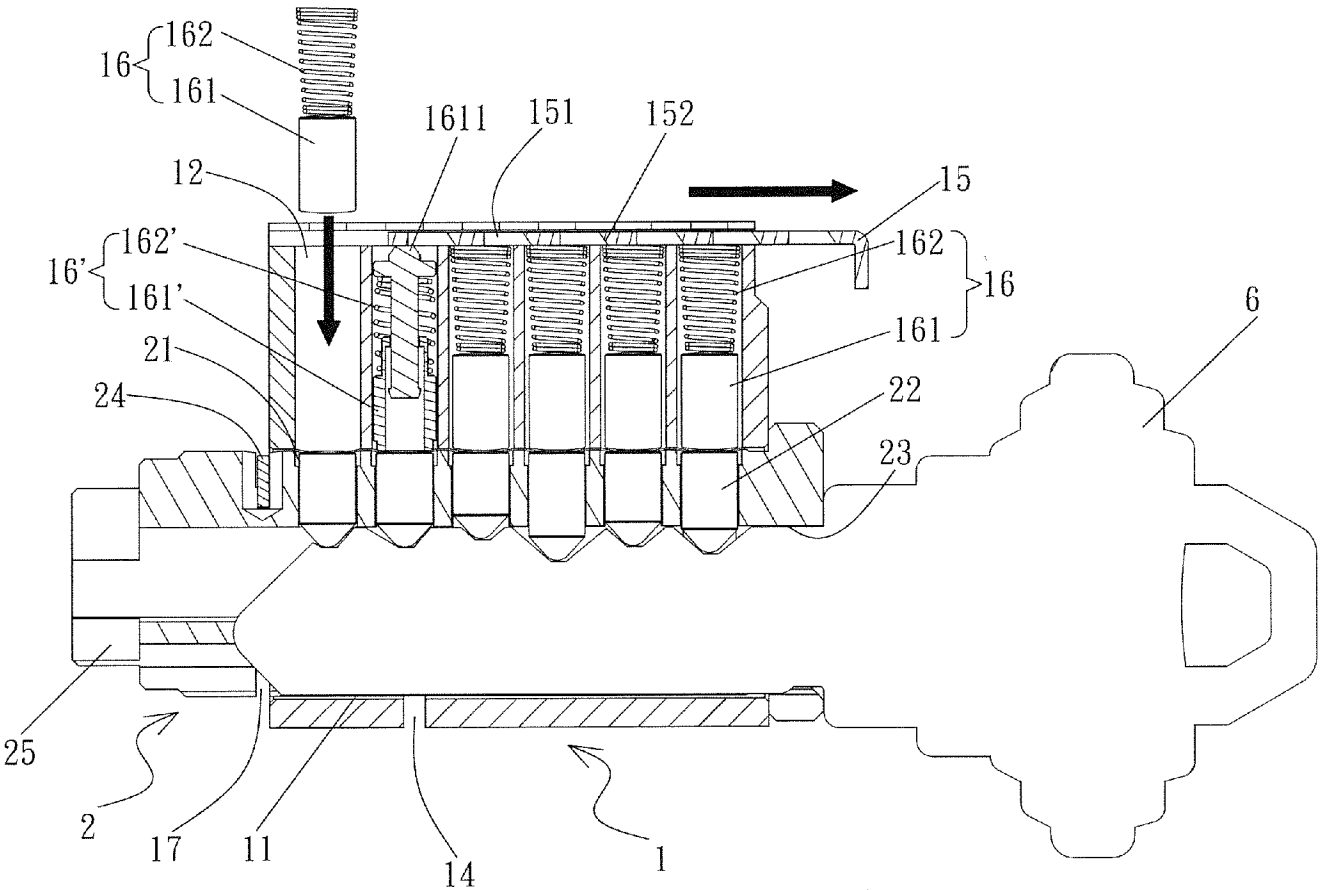
FIG. 19 is a cross sectional view to show that the third key is used and the stop is removed so as to install the top pin units.
Figure 20:
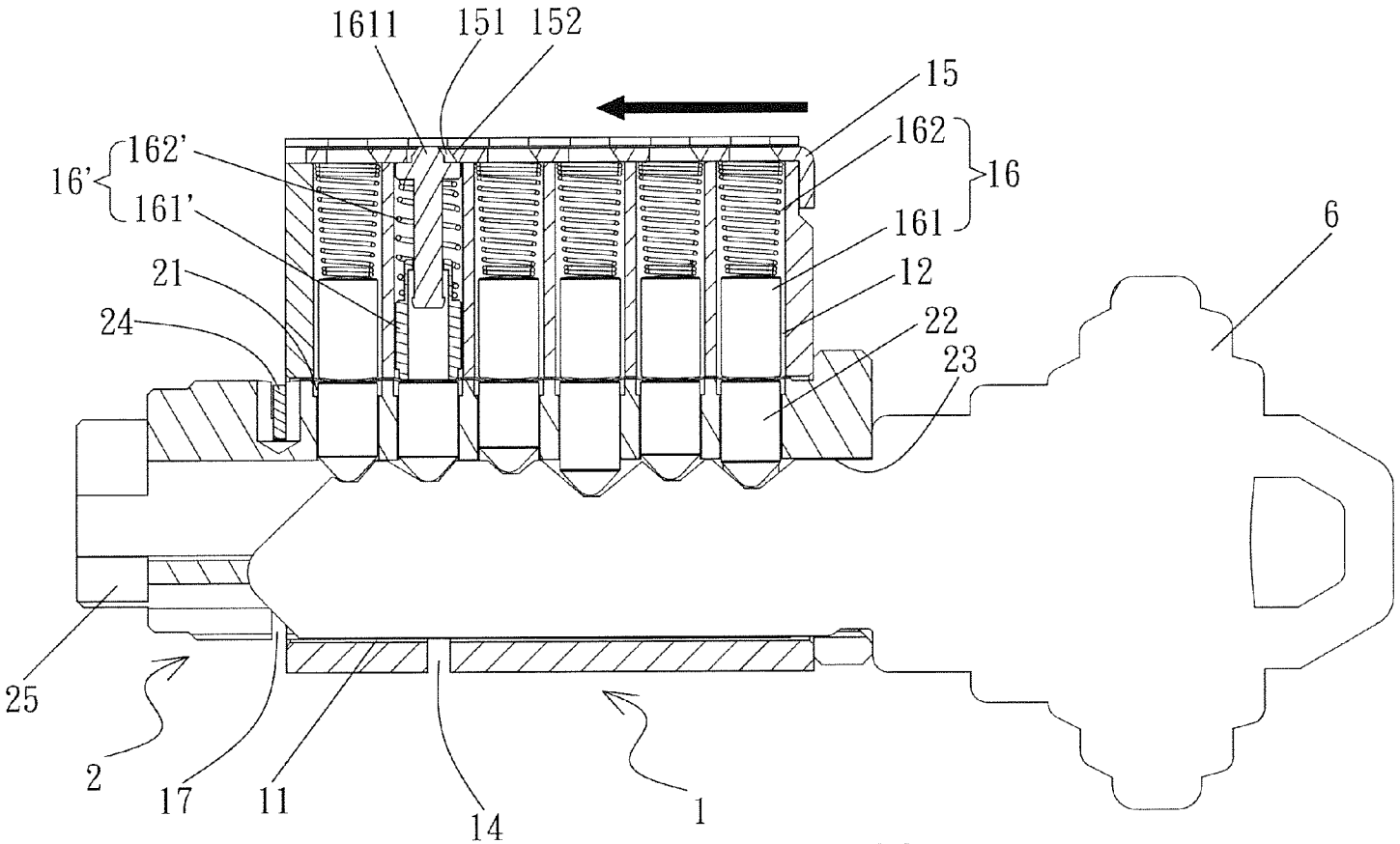
FIG. 20 is a cross sectional view to show that the third key is used and the stop is installed to the lock.

During the rotation of the core 2 by the first key 4, as shown in FIGS. 9 and 10, when the positioning unit 3 is co-rotated and aligned with the top pin holes 12, the positioning piece 33 is pushed by the top pin unit 16' and the resilient piece 32 is compressed. However, with the positioning unit 3 being compressed into the space 11 of the housing 1, the protrusion 241 of the E-shaped clip is not aligned to the recess so that the connection member 24 cannot be engaged with the connection portion 17, so that the core 2 is not moved axially, and the positioning unit 3 contacts the top pin unit 16' to ensure that the core 2 can be rotated 360 degrees to unlock the lock.

The number of the through holes 13 is decided by the required number of sets of the top and bottom pin holes 12, 21. The number of the bottom pin units 22 can be replaced with the same number of sets or different number sets. As shown In FIGS. 11 to 16, when using the first key 4 to unlock the lock to rotate the bottom pin holes 21 to the through holes 13, in this embodiment, the core 2 is rotated 90 degrees, the connection member 24 is moved to the position corresponding to the connection portion 17. The user uses a tool with a tip (not shown) to push the positioning unit 3 to compress the resilient piece 32 and the positioning piece 33 is merged into the elongate hole 311 so that the core 2 is moved axially to let the connection member 24 be engaged with the connection portion 17. In other words, the core 2 is moved toward the key hole 23 and the protrusion 241 of the E-shaped clip is engaged with the recess, and the positioning unit 3 is moved axially into the space 11. The through holes 13 are in communication with the bottom pin holes 21, so that the bottom pin units 22 can be pulled out from the bottom pin holes 21 via the through holes 13, and the first key 4 is removed. The removal of the bottom pin units 22 and the first key 4 can be done without restriction of sequence. The user then inserts the second key 5 into the key hole 23 and the proper bottom pin units 22 that are matched with the notches of the second key 5 are installed into the bottom pin holes 21 and the through holes 13. The core 2 is then moved away from the key hole 23 to return the connection member 24 and the positioning unit 3. The through holes 13 and the bottom pin holes 21 are located alternative to each other. The bottom pin units 22 that is matched with the second key 5 cannot remove from the through holes 13 and the bottom pin holes 21. The second key 5 is used to rotate the core 2 to a position where the key hole 23 is in alignment with the top pin holes 12 so that the second key 5 is the correct key for the lock.

After the bottom pin units 22 that are matched with the second key 5 are successfully replaced, even if the first key 4 is used again, because the notches of the first key 4 are not matched with to the bottom pin units 22, the core 2 cannot be rotated.

When replaced with different number of sets of the bottom pin holes 22, the steps are the same as mentioned above, either the first or the second key 4, 5 is used, the through holes 13 are first rotated to be in alignment with the bottom pin holes 21 to remove the bottom pin units 22 from the lock. As shown in FIGS. 17 to 20, the third key 6 is inserted into the key hole 23 and the bottom pin units 22 that is matched with the third key 6 are installed to the through holes 13 and the bottom pin holes 21. The original five sets of the bottom pin units 22 that are installed in the bottom pin holes 21 are replaced with six sets of the bottom pin units 22 to match the third key 6. By the reposition the connection member 24 and the positioning unit 3, the through holes 13 and the bottom pin holes 21 are located alternative to each other. The third key 6 is rotated to rotate the core 2 back to the position where the key hole 23 is located corresponding to the top pin holes 12. The lock has five sets of the top pin units 16, in order to let the third key 6 to unlock the lock, the user uses a tool with a tip (not shown) to push the top pin unit 16' which has the driving member 1611 to compress the resilient member 162' and the driving member 1611 is pushed through the aperture 151 so that the stop 15 is released and then removed, and the sixth top pin unit 16 is installed into the top pin hole 12 and located corresponding to the sixth set of the bottom pin unit 22. The stop 15 is repositioned to cover the top pin holes 12 with the driving member 1611 engaging the aperture 151, the third key 6 is then able to lock and unlock the lock. The inclined face 152 of the aperture 151 helps the stop 15 to be back to its initial position. By replacing the same number or different number of the bottom pin units 22, and by cooperation with the change of top pin units 16, the lock can be cooperated with multiple keys.

The transmission unit 25 is integrally manufactured in this embodiment, nevertheless, the transmission unit 25 can also be secured by using a bolt and a nut, so that the transmission unit 25 can be used in different locks.

Figure 21:
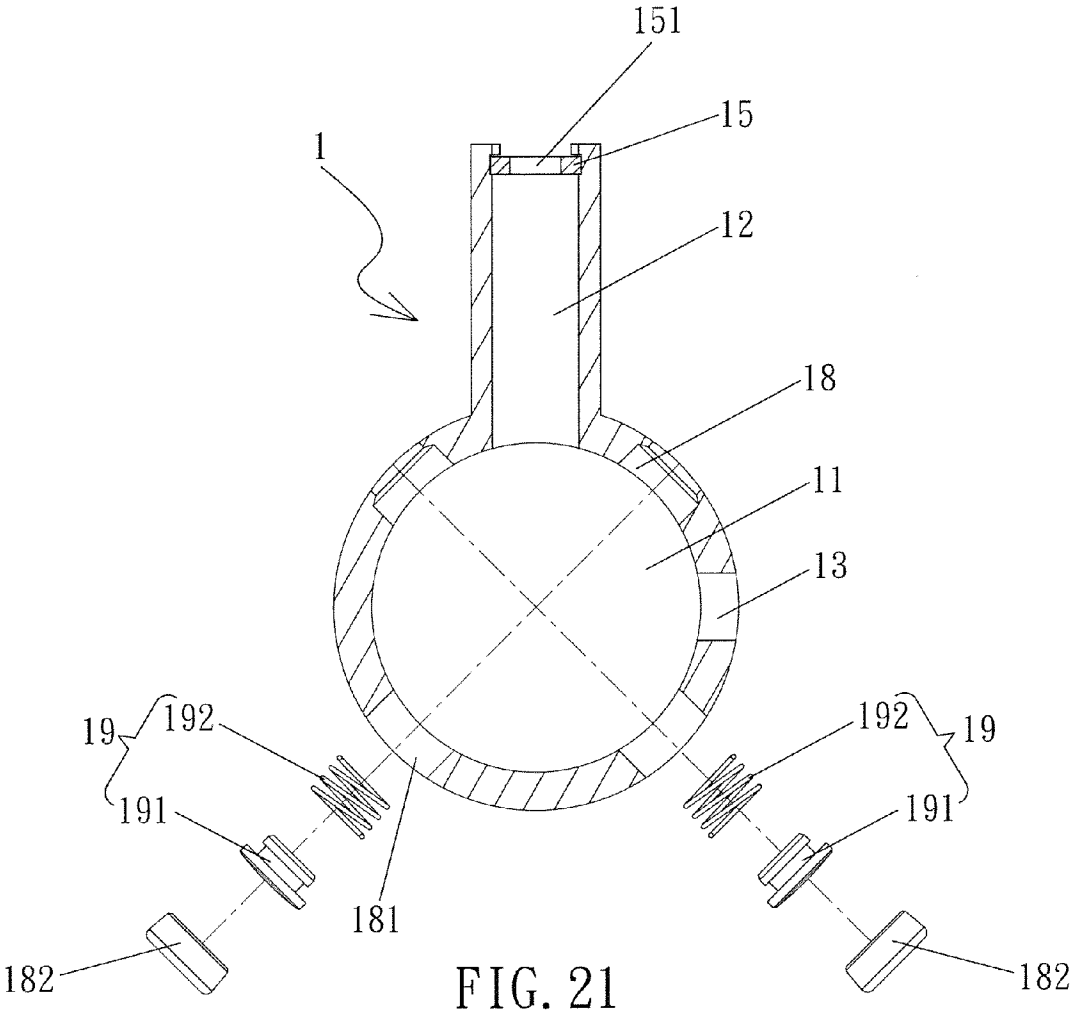
FIG. 21 is a cross sectional view to show the side pin units.
Figure 22:
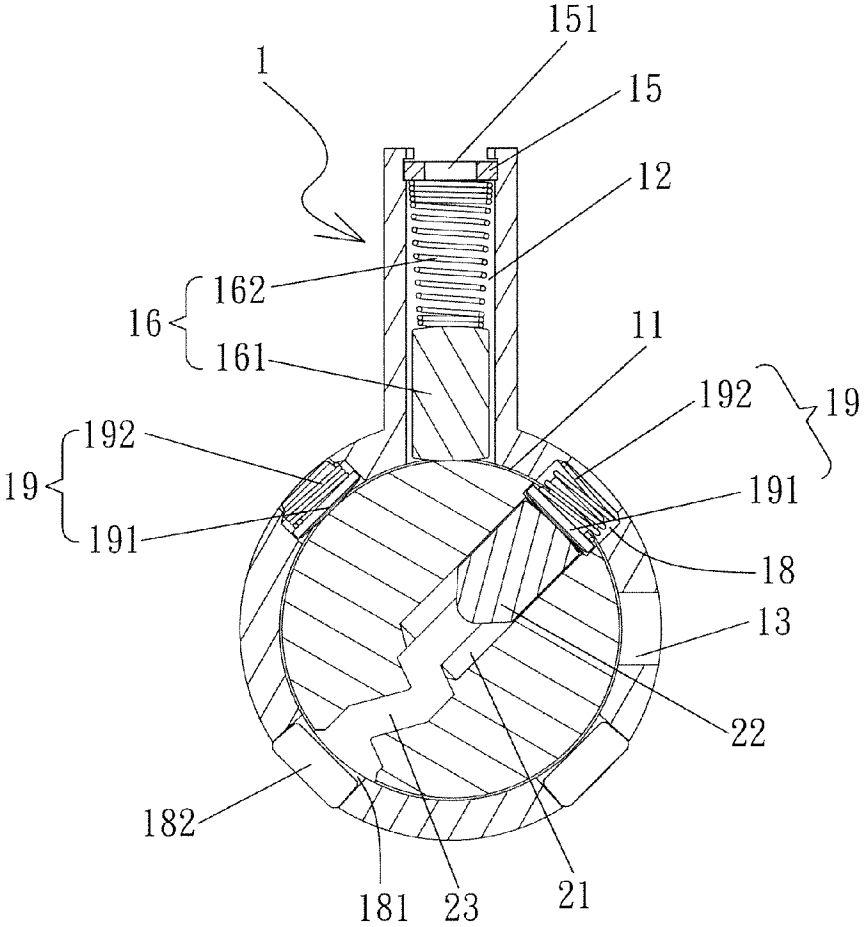
FIG. 22 is a cross sectional view to show that the side pin units form a locked mechanism.

Furthermore, as shown in FIGS. 21 and 22, to further restrict the lock to operation with the proper key, the housing 1 may have at least one side pin hole 18 defined therethrough and the at least one side pin hole 18 is located between the top pin hole 12 and the through hole 13. The at least one side pin hole 18 receives a side pin unit 19. The side pin unit 19 comprises a side pin 191 and a spring member 192. The housing 1 has a filling hole 181 which is located diametrically in opposite to the at least one side pin hole 18. The side pin unit 19 is inserted into the at least one side pin hole 18 via the filling hole 181. The filling hole 181 is covered by a cover 182. When an unauthorized unlocking action by using a universal key or L-shaped wrench to unlock the lock, the core 2 may be rotated, but the bottom pin units 22 cannot be pushed as using a correct key. Therefore, when the bottom pin units 22 are co-rotated and face the at least one side pin hole 18, there is a distance between the bottom pin units 22 and the at least one side pin hole 18, the side pin 191 of the at least one side pin hole 18 is not biased by the spring member 192 and engaged with the bottom pin hole 21 so that the core 2 is not rotated by using the universal key or L-shaped wrench.

The bottom pin units of the lock of the present invention can be easily replaced. The user simply rotates the core to align the bottom pin holes with the through holes, the positioning unit is released by using a tool with a tip so as to release the housing and the core. The protrusion on the E-shaped clip is engaged with the recess so as to drive the core axially and to align the bottom pin holes with the through holes again. The through holes are in communication with the bottom pin holes. The bottom pin units are able to be replaced via the through holes so that a new key can be used to lock and unlock the lock.

The same number or different number of sets of the bottom pin units can be replaced according to needs. The top pin with the driving member is compressed to push the stop so as to replace the top pin units from the top pin holes. The inclined face of the aperture helps the stop to be back to its initial position. By this way, the lock can have different combinations of locking features.

By the side pin units and the position unit, when the lock is hit or picked from exterior, the side pin units are stocked in the bottom pin holes and the positioning unit stops tool from entering the gap of the housing so that the core cannot be rotated, and therefore provides two protections against unauthorized actions to the lock.

While we have shown and described the embodiment in accordance with the present invention, it should be clear to those skilled in the art that further embodiments may be made without departing from the scope of the present invention.

What is claimed is:

1. A lock comprising:

a housing having a space defined axially therein, multiple top pin holes defined radially through the housing, the housing having multiple through holes which are located corresponding to the space, and a core being located in the space defined by said housing and having multiple bottom pin holes defined radially, the bottom pin holes communicating with the top pin holes respectively, a key hole being defined in a first end of the core and a connection member connected to a second end of the core, the key hole communicating with the bottom pin holes, the housing having a connection portion located radially offset to the connection member, the through holes being located axially offset to the bottom pin holes; the through holes communicating with the bottom pin holes when the bottom pin holes are rotated to the through holes, the core is moved axially and the connection member is aligned with the connection portion, the connection member is coupled to a transmission unit for rotation as a key is rotated to align at least one protrusion of the connection member with said connection portion of said housing whereby when said core is rotated to a predetermined angle, the core can be axially displaced for alignment between the bottom pin holes and the multiple through holes formed through the housing.

2. The lock as claimed in claim 1, wherein the connection member has said protrusion located corresponding to the connection portion.

3. The lock as claimed in claim 1, wherein bottom pin units are received in the bottom pin holes, a diameter of the through holes is sized for allowing the bottom pin units to be inserted into the bottom pin holes.

4. The lock as claimed in claim 1, wherein the housing has a groove and the core has a positioning unit retained within a core recess in the core and aligned with the groove, the positioning unit is selectively engaged with the groove.

5. The lock as claimed in claim 4, wherein the positioning unit comprises a block, a resilient piece and a positioning piece, the block is connected to the outside of the core, a room is defined between the core and the block, the resilient piece and the positioning piece are located in the room, the block has an elongate hole, the resilient piece has a first end contacting the outside of the core and a second end of the resilient piece is connected to the positioning piece, the positioning piece extends through the elongate hole and is selectively engaged with the groove.

6. The lock as claimed in claim 1, wherein the housing has a stop connected thereto and the stop has at least one aperture which is located corresponding to the top pin hole, multiple top pin units are located in the top pin holes and the stop retains the multiple top pin units within the top pin holes, one of the top pin units comprises a top pin and a resilient member, the top pin has a driving member on a top thereof and the driving member extends through the at least one aperture to secure the stop.

7. The lock as claimed in claim 6, wherein the at least one aperture has an inclined face which is gradually and outwardly narrowed.

8. The lock as claimed in claim 1, wherein said transmission unit is connected to the second end of the core.

9. The lock as claimed in claim 1, wherein the housing has at least one side pin hole defined therethrough and the at least one side pin hole is located between the top pin hole and the through hole, the at least one side pin hole receives a side pin unit.

10. The lock as claimed in claim 9, wherein the side pin unit comprises a side pin and a spring member, the housing has a filling hole which is located diametrically in opposite to the at least one side pin hole, the side pin unit is inserted into the at least one side pin hole via the filling hole, the filling hole is covered by a cover.

* * * * *